US011204568B2

(12) United States Patent
Ahn et al.

(10) Patent No.: US 11,204,568 B2
(45) Date of Patent: Dec. 21, 2021

(54) PLUNGER LOCKING STRUCTURE IN SYRINGE TYPE TONER REFILL CARTRIDGE

(71) Applicant: Hewlett-Packard Development Company, L.P., Spring, TX (US)

(72) Inventors: Yongnam Ahn, Seongnam-si (KR); Woongyong Choi, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/047,534

(22) PCT Filed: Mar. 21, 2019

(86) PCT No.: PCT/US2019/023413

§ 371 (c)(1),
(2) Date: Oct. 14, 2020

(87) PCT Pub. No.: WO2020/046425

PCT Pub. Date: Mar. 5, 2020

(65) Prior Publication Data

US 2021/0116838 A1 Apr. 22, 2021

(30) Foreign Application Priority Data

Aug. 30, 2018 (KR) ..... 10-2018-0102529

(51) Int. Cl.
*G03G 15/08* (2006.01)
*G03G 21/16* (2006.01)

(52) U.S. Cl.
CPC ..... *G03G 15/0877* (2013.01); *G03G 15/0867* (2013.01); *G03G 15/0874* (2013.01); *G03G 15/0894* (2013.01); *G03G 21/1676* (2013.01)

(58) Field of Classification Search
CPC ..... G03G 15/0865; G03G 15/0886; G03G 21/1676; G03G 15/0867; G03G 15/0877; G03G 2215/0692
See application file for complete search history.

(56) References Cited

U.S. PATENT DOCUMENTS 5,089,854 A * 2/1992 Kaieda ..... G03G 15/0855 141/346
6,269,234 B1 * 7/2001 Kurz ..... G03G 15/0896 399/258

(Continued)

FOREIGN PATENT DOCUMENTS

GB 2 435 696 A 9/2007
JP 3-118569 A 5/1991

(Continued)

*Primary Examiner* — Walter L Lindsay, Jr.
*Assistant Examiner* — Jessica L Eley
(74) *Attorney, Agent, or Firm* — Jefferson IP Law, LLP

(57) ABSTRACT

A toner cartridge includes a hollow body having an inner space in which toner is received and a toner discharge portion through which the toner is discharged, a plunger accommodated in the inner space to be movable in a longitudinal direction along the inner space and configured to push the toner through the toner discharge portion to outside of the body, a first hook provided on the body, and a second hook. The second hook has a shape complementary to a shape of the first hook, is provided on the plunger, and is elastically coupled to the first hook when the plunger reaches a bottom dead position.

20 Claims, 9 Drawing Sheets

(56) References Cited

U.S. PATENT DOCUMENTS

| | | | | |
|---|---|---|---|---|
| 6,862,420 | B1 | 3/2005 | Less | |
| 2013/0170871 | A1* | 7/2013 | Buchanan | G03G 15/0886 399/260 |
| 2014/0356016 | A1* | 12/2014 | Buchanan | G03G 15/0875 399/98 |
| 2016/0062268 | A1 | 3/2016 | Nakaue et al. | |
| 2016/0223945 | A1 | 8/2016 | Hayashi | |

FOREIGN PATENT DOCUMENTS

| | | | |
|---|---|---|---|
| JP | 4-276780 | A | 10/1992 |
| JP | H06-222663 | A | 8/1994 |
| JP | 2003-29516 | A | 1/2003 |
| JP | 2003-84549 | A | 3/2003 |
| KR | 10-2006-0088414 | A | 8/2006 |

* cited by examiner

PLUNGER LOCKING STRUCTURE IN SYRINGE TYPE TONER REFILL CARTRIDGE

BACKGROUND

A printer using an electrophotographic method forms a visible toner image on a photoconductor by supplying toner to an electrostatic latent image formed on the photoconductor, transfers the toner image to a print medium directly or through an intermediate transfer medium, and then fixes the transferred toner image on the print medium.

A development cartridge receives toner, and the visible toner image is formed by the development cartridge supplying the toner to the electrostatic latent image formed on the photoconductor. When the development cartridge runs out of toner, the development cartridge may be removed from a main body of a printer and a new development cartridge may be mounted on the main body. The development cartridge may be refilled with new toner by using a toner refill kit (e.g., a toner cartridge).

DETAILED DESCRIPTION

Figure 1:
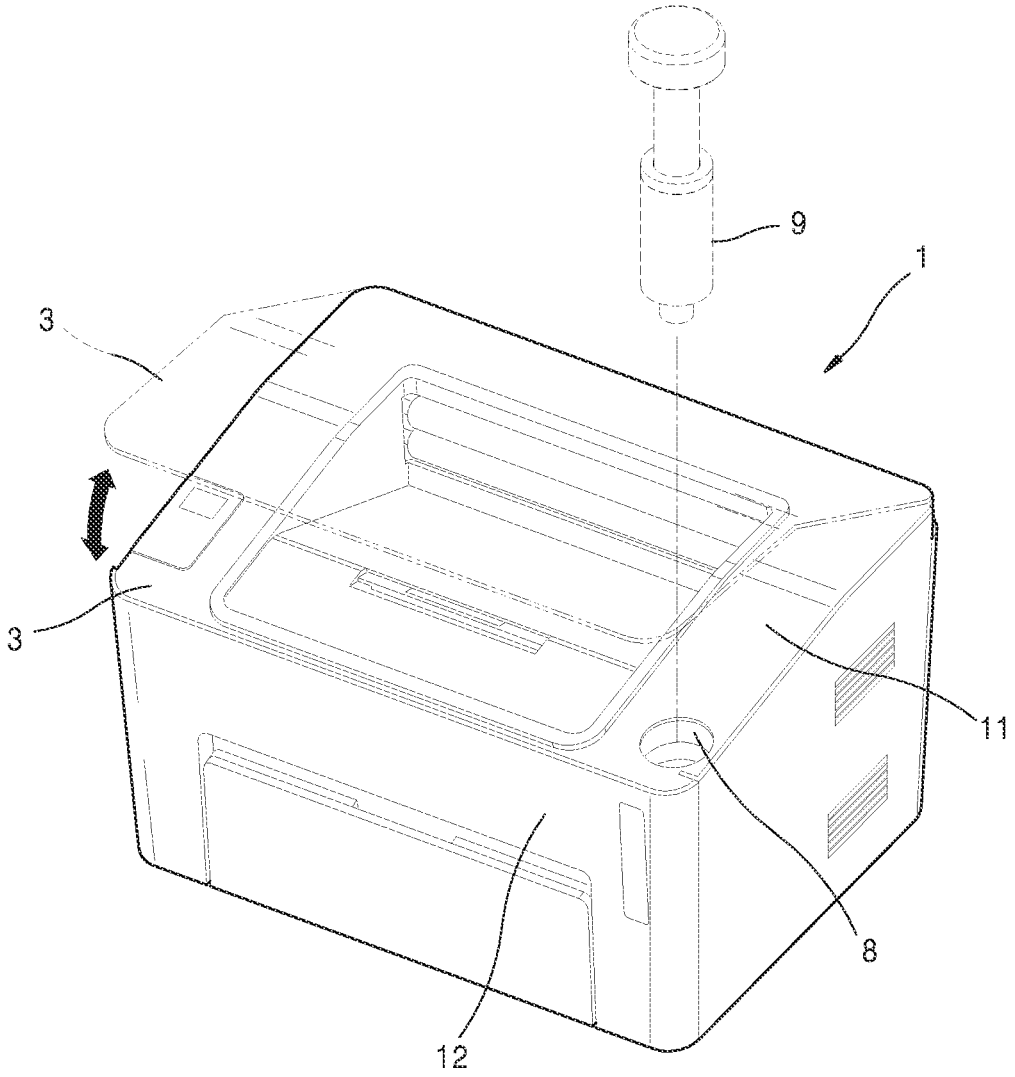
FIG. 1 is a perspective view illustrating an outer appearance of an electrophotographic printer according to an example.
Figure 2:
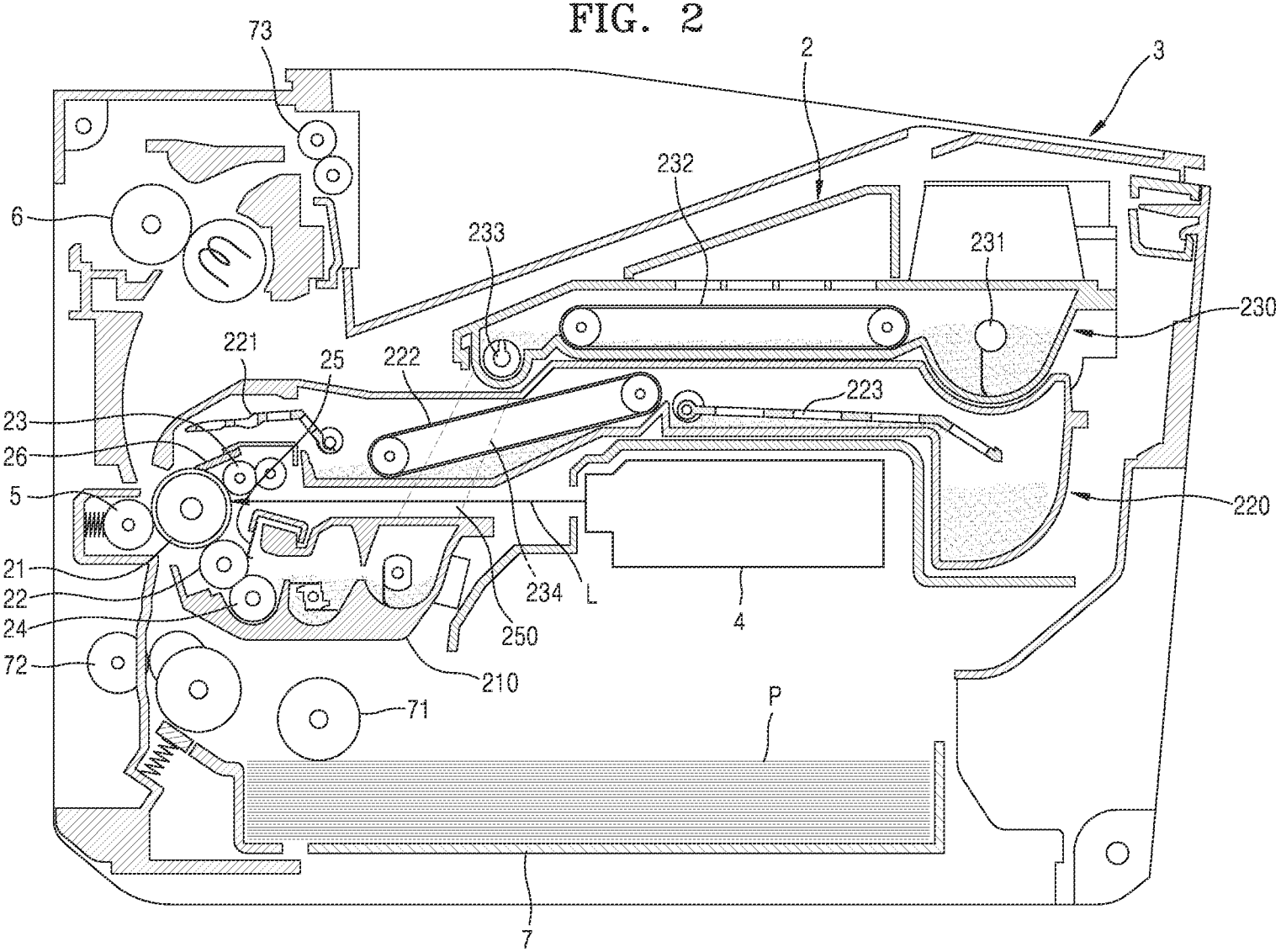
FIG. 2 is a view illustrating a configuration of the electrophotographic printer of FIG. 1, according to an example.
Figure 3:
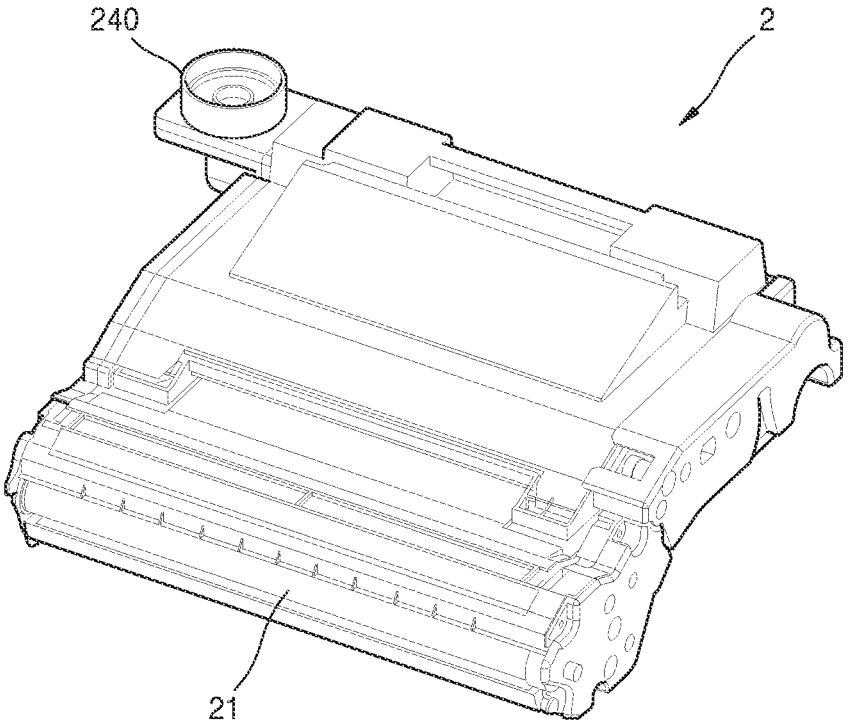
FIG. 3 is a perspective view of a development cartridge used in the electrophotographic printer of FIG. 1, according to an example.

FIG. 1 is a perspective view illustrating an outer appearance of an electrophotographic printer according to an example. FIG. 2 is a view illustrating a configuration of the electrophotographic printer of FIG. 1, according to an example. FIG. 3 is a perspective view of a development cartridge used in the electrophotographic printer of FIG. 1, according to an example. Referring to FIGS. 1, 2, and 3, a printer may include a main body 1 and a development cartridge 2 attachable to/detachable from the main body 1. A door 3 may be provided on the main body 1. The door 3 opens/closes a portion of the main body 1. Although the door 3 opens a upper portion of the main body 1 in FIG. 1, a door for opening a side portion of the main body 1 or a front portion of the main body 1 may be used, if necessary. The door 3 may be opened and the development cartridge 2 may be attached to/detached from the main body 1.

A photosensitive drum 21 that is a photoconductor on which an electrostatic latent image is formed may include a cylindrical metal pipe and a photosensitive layer having photoconductivity and formed on an outer circumferential surface of the cylindrical metal pipe. A charging roller 23 is a charger for charging a surface of the photosensitive drum 21 to a uniform electric potential. A charging bias voltage is applied to the charging roller 23. A corona charger (not shown), instead of the charging roller 23, may be used. A developing roller 22 supplies toner to the electrostatic latent image formed on the surface of the photosensitive drum 21 and develops the electrostatic latent image.

When a two-component development method using toner and a carrier as a developer is used, the developing roller 22 may include a rotating sleeve and a magnet fixedly located inside the rotating sleeve. The rotating sleeve may be spaced apart from the photosensitive drum 21 by tens to hundreds of micrometers. The carrier is attached to an outer circumferential surface of the developing roller 22 due to a magnetic force of the magnet, and the toner is attached to the carrier due to an electrostatic force, and thus a magnetic brush formed of the carrier and the toner is formed on the outer circumferential surface of the developing roller 22. The toner is moved to the electrostatic latent image formed on the photosensitive drum 21 due to a developing bias voltage applied to the developing roller 22.

When a one-component development method using toner as a developer is used, the developing roller 22 may contact the photosensitive drum 21, or may be spaced apart from the photosensitive drum 21 by tens to hundreds of micrometers. In the example, a one-component development method in which a development nip is formed when the developing roller 22 and the photosensitive drum 21 contact each other is used. The developing roller 22 may include a conductive metal core (not shown) and an elastic layer (not shown) formed on an outer circumferential surface of the conductive metal core. When a developing bias voltage is applied to the developing roller 22, the toner is moved and attached to the electrostatic latent image formed on the surface of the photosensitive drum 21 through the development nip.

A supply roller 24 allows toner to be attached to the developing roller 22. A supply bias voltage may be applied to the supply roller 24 so that toner is attached to the developing roller 22. Reference numeral 25 denotes a regulating member for regulating the amount of toner attached to a surface of the developing roller 22. The regulating member 25 may be a regulating blade whose front end contacts the developing roller 22 at a predetermined pressure. Reference numeral 26 denotes a cleaning member for removing residual toner and a foreign material from the surface of the photosensitive drum 21 before a charging operation. The cleaning member 26 may be a cleaning blade whose front end contacts the surface of the photosensitive drum 21. Hereinafter, the foreign material removed from the surface of the photosensitive drum 21 is referred to as waste toner.

An optical scanner 4 scans light modulated according to image information to the surface of the photosensitive drum 21 charged to a uniform electric potential. A laser scanning unit (LSU) of deflecting light emitted from a laser diode in a main scanning direction by using a polygon mirror and scanning the deflected light to the photosensitive drum 21 may be used as the optical scanner 4.

A transfer roller 5 is a transfer unit facing the photosensitive drum 21 and configured to form a transfer nip. A transfer bias voltage for transferring the toner image developed on the surface of the photosensitive drum 21 to a print medium P is applied to the transfer roller 5. A corona transfer unit, instead of the transfer roller 5, may be used.

The toner image transferred to a surface of the print medium P by the transfer roller 5 is maintained on the surface of the print medium P due to electrostatic attraction.

A fuser 6 forms a permanent print image on the print medium P by fixing the toner image onto the print medium P by applying heat and pressure.

Referring to FIGS. 2 and 3, the development cartridge 2 of the example includes a developing portion 210 in which the photosensitive drum 21 and the developing roller 22 are provided, a waste toner container 220 in which waste toner removed from the photosensitive drum 21 is received, and a toner container 230 connected to the developing portion 210 and allowing toner to be received therein. In order to refill the toner container 230 with toner, the development cartridge 2 includes a toner refilling portion 240 connected to the toner container 230. The toner refilling portion 240 provides an interface between a toner cartridge 9 which will be described later and the development cartridge 2. The development cartridge 2 is an integrated development cartridge including the developing portion 210, the waste toner container 220, the toner container 230, and the toner refilling portion 240.

A portion of an outer circumferential surface of the photosensitive drum 21 is exposed to the outside of a housing. The transfer roller 5 contacts the exposed portion of the photosensitive drum 21 to form a transfer nip. At least one conveying member for conveying toner to the developing roller 22 may be provided on the developing portion 210. The conveying member may agitate the toner and may charge the toner to a predetermined potential.

The waste toner container 220 is located over the developing portion 210. The waste toner container 220 is spaced apart from the developing portion 210 so that a light path 250 is formed between the waste toner container 220 and the developing portion 210. Waste toner removed from the photosensitive drum 21 by the cleaning member 26 is received in the waste toner container 220. The waste toner removed from the surface of the photosensitive drum 21 is transported into the waste toner container 220 by one or more waste toner transporting members 221, 222, and 223. Shapes and the number of waste toner transporting members are not limited. An appropriate number of waste toner transporting members may be provided at appropriate positions in order to effectively disperse the waste toner in the waste toner container 220 in consideration of a volume or a shape of the waste toner container 220.

The toner container 230 is connected to the toner refilling portion 240 and receives toner therein. The toner container 230 is connected to the developing portion 210 by a toner supply portion 234 as marked by a dashed line of FIG. 2. As shown in FIG. 2, the toner supply portion 234 may vertically pass through the waste toner container 220 and may be connected to the developing portion 210. The toner supply portion 234 is located outside an effective width of exposure light L in order not to interfere with the exposure light L scanned in the main scanning direction by the optical scanner 4.

One or more toner supply members 231, 232, and 233 for supplying toner through the toner supply portion 234 to the developing portion 210 may be provided in the toner container 230. Shapes and the number of toner supply members are not limited. An appropriate number of toner supply members may be provided at appropriate positions in the toner container 230 in order to effectively supply the toner to the developing portion 210 in consideration of a volume or a shape of the toner container 230. The toner supply member 233 may convey the toner in the main scanning direction to the toner supply portion 234.

An image forming process will now be described briefly. A charging bias voltage is applied to the charging roller 23, and the photosensitive drum 21 is charged to a uniform electric potential. The optical scanner 4 forms an electrostatic latent image on a surface of the photosensitive drum 21 by scanning light modulated to correspond to image information to the photosensitive drum 21. The supply roller 24 allows toner to be attached to a surface of the developing roller 22. The regulating member 25 forms a toner layer having a uniform thickness on the surface of the developing roller 22. A developing bias voltage is applied to the developing roller 22. As the developing roller 22 rotates, the toner conveyed to a development nip is moved and attached to the electrostatic latent image formed on the surface of the photosensitive drum 21 due to the developing bias voltage and a visible toner image is formed on the surface of the photosensitive drum 21. The print medium P picked up from a loading tray 7 by a pickup roller 71 is fed by a feed roller 72 to a transfer nip where the transfer roller 5 and the photosensitive drum 21 face each other. When a transfer bias voltage is applied to the transfer roller 5, the toner image is transferred to the print medium P due to electrostatic attraction. The toner image transferred to the print medium P is fixed onto the print medium P due to heat and pressure applied by the fuser 6, thereby completing a printing operation. The print medium P is discharged by a discharge roller 73. A portion of the toner remaining on the surface of the photosensitive drum 21 without being transferred to the print medium P is removed by the cleaning member 26.

As described above, the development cartridge 2 includes the toner refilling portion 240 for refilling toner. Accordingly, the development cartridge 2 may be refilled with toner in a state where the development cartridge 2 is mounted on the main body 1, without being removed from the main body 1.

Referring to FIG. 1, a communicating portion 8 is formed in the main body 1 so as to access the toner refilling portion 240 from the outside of the main body 1 in a state where the development cartridge 2 is mounted on the main body 1. For example, when a toner cartridge (e.g., a toner refill kit) 9 in which toner is received is inserted into the communicating portion 8, the toner cartridge 9 may be connected to the toner refilling portion 240. In this state, the toner received in the toner cartridge 9 may be refilled in the toner container 230 through the toner refilling portion 240. The toner cartridge 9 is removed from the communicating portion 8 after the toner is refilled.

In this configuration, since toner may be refilled in the toner container 230 through the toner refilling portion 240, a replacement time of the development cartridge 2 may be extended until a lifetime of the photosensitive drum 21 ends, thereby reducing printing costs per sheet. Since toner may be refilled in a state where the development cartridge 2 is mounted on the main body 1, user convenience may be improved.

The communicating portion 8 may be provided at a position close to a front portion 12 (see FIG. 1) of the main body 1. Since the front portion 12 faces a user, the user may easily access the communicating portion 8. Accordingly, a toner refilling operation through the communicating portion 8 may be easily performed.

The communicating portion 8 may be formed in a top surface 11 of the main body 1. The toner refilling portion 240 is located under the communicating portion 8. The communicating portion 8 and the toner refilling portion 240 may be vertically aligned with each other. The toner cartridge 9 may access the toner refilling portion 240 from the top of the main body 1 through the communicating portion 8. For example, when the toner cartridge 9 is inserted from the top of the main body 1 into the communicating portion 8, the toner cartridge 9 may be connected to the toner refilling portion 240.

Examples of the toner cartridge 9 will now be described.

Figure 4:
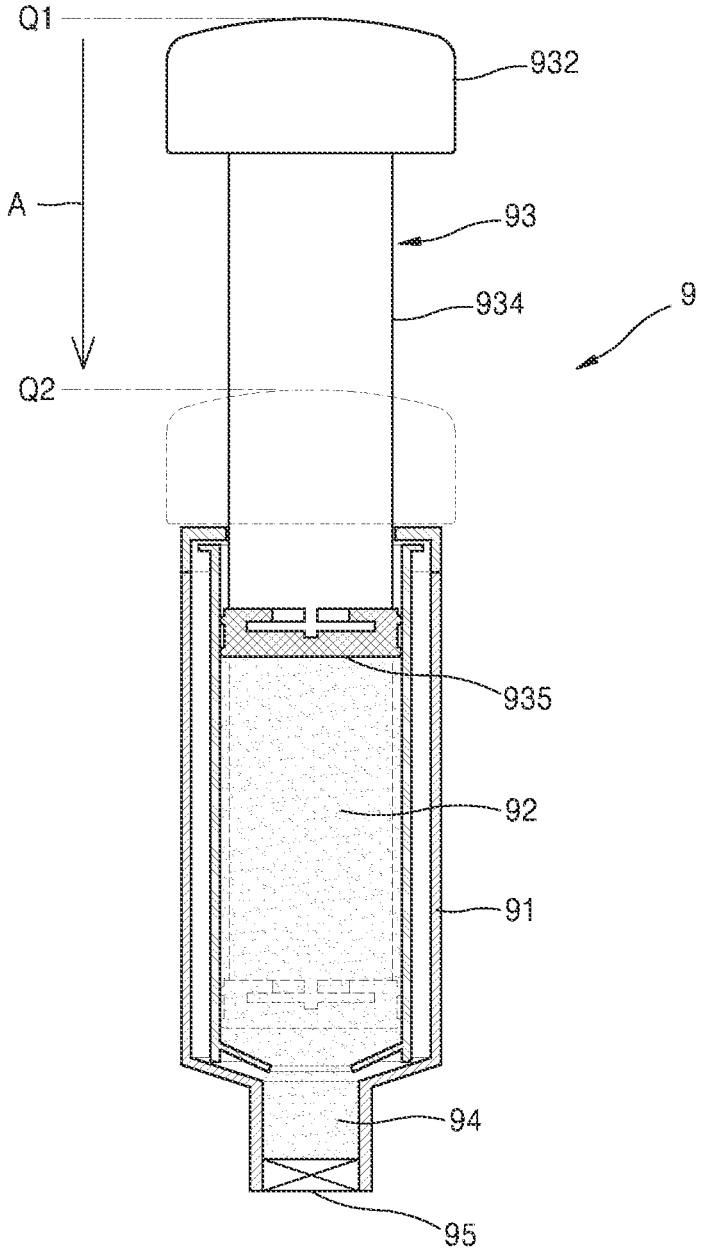
FIG. 4 is a cross-sectional view of a toner cartridge according to an example.

FIG. 4 is a cross-sectional view of the toner cartridge 9 according to an example. Referring to FIG. 4, the toner cartridge 9 may be a syringe-type toner cartridge including a body 91 that is hollow and has an inner space 92 in which toner is received and a plunger 93 that is accommodated in the inner space 92 to be movable in a longitudinal direction A and pushes the toner to the outside of the body 91. The body 91 may have, for example, a cylindrical shape. A toner discharge portion 94 through which the toner is discharged and a discharge shutter 95 configured to open/close the toner discharge portion 94 may be provided on an end portion of the body 91. For example, the discharge shutter 95 may open the toner discharge portion 94 when the toner cartridge 9 is connected to the toner refilling portion 240 of the development cartridge 2. Although not shown in FIG. 4, an operating lever for manually operating the discharge shutter 95 may be provided on the toner cartridge 9.

The plunger 93 may include an insertion rod 934 extending in the longitudinal direction A and inserted into the inner space 92 and a packing portion 935 provided on a first end portion of the insertion rod 934 and configured to push the toner in the inner space 92. A pressing portion 932 is provided on a second end portion of the insertion rod 934. A user may move the plunger 93 from a top dead position Q1 to a bottom dead position Q2 by pressing the pressing portion 932. The plunger 93 is inserted into the inner space 92 from a portion of the body 91 opposite to the toner discharge portion 94. The plunger 93 is moved from the top dead position Q1 to the bottom dead position Q2 in the longitudinal direction A along the inner space 92 and pushes the toner through the toner discharge portion 94 to the outside of the body 91. When the plunger 93 reaches the bottom dead position Q2, injection of the toner is completed.

Figure 5:
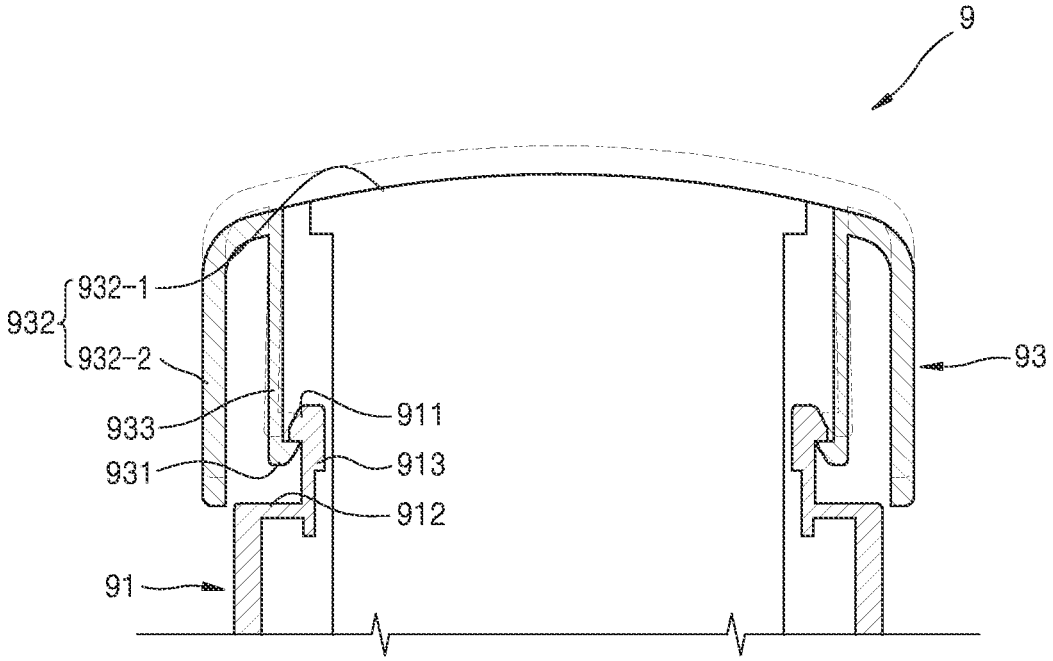
FIG. 5 is a partial cross-sectional view of the toner cartridge when a plunger reaches a bottom dead position.

FIG. 5 is a partial cross-sectional view of the toner cartridge 9 when the plunger 93 reaches the bottom dead position Q2. Referring to FIG. 5, a first hook 911 is provided on the body 91. A second hook 931 having a shape complementary to that of the first hook 911 and elastically coupled to the first hook 911 when the plunger 93 reaches the bottom dead position Q2 may be provided on the plunger 93.

For example, the first hook 911 may be provided on an end portion of the body 91 opposite to the toner discharge portion 94. A sunken portion 912 that is inwardly partially recessed may be formed in the end portion of the body 91 opposite to the toner discharge portion 94, and the first hook 911 may be provided on the sunken portion 912.

The second hook 931 may be provided on the pressing portion 932. The pressing portion 932 may include an upper wall 932-1 and a side wall 932-2 extending from the upper wall 932-1 in the longitudinal direction A. The side wall 932-2 may surround the sunken portion 912 so that the sunken portion 912 is not exposed to the outside when the plunger 93 reaches the bottom dead position Q2. The second hook 931 may be provided on an end portion of an elastic arm 933 extending downward from the upper wall 932-1 of the pressing portion 932. The elastic arm 933 and the second hook 931 may be located inside the side wall 932-2 so as not to be exposed to the outside.

In this configuration, when the plunger 93 approaches the bottom dead position Q2, the first hook 911 and the second hook 931 interfere with each other, and the elastic arm 933 is elastically bent as marked by a dashed line of FIG. 5. When the plunger 93 reaches the bottom dead position Q2, the elastic arm 933 returns to its original position due to an elastic force as marked by a solid line of FIG. 5, and the first hook 911 and the second hook 931 are elastically engaged with each other.

When the plunger 93 is continuously pressed even after the plunger 93 reaches the bottom dead position Q2, an excessive force may be applied to the development cartridge 2 and the development cartridge 2 or the toner refilling portion 240 may be damaged. In the example, when the plunger 93 reaches the bottom dead position Q2, a small impact occurs when the first hook 911 and the second hook 931 are elastically engaged with each other and is transmitted to a user's hand pressing the pressing portion 932. Accordingly, the user may recognize that the plunger 93 has reached the bottom dead position Q2 and may remove a pressing force applied to the pressing portion 932.

In order to elastically couple the first hook 911 and the second hook 931, at least one of the first hook 911 and the second hook 931 may be supported by an elastic arm. Although the second hook 931 is supported by the elastic arm 933 in the example, a portion 913 extending from the sunken portion 912 and supporting the first hook 911 may be an elastic arm. Each of the first hook 911 and the second hook 931 may be supported by an elastic arm.

The toner cartridge 9 may include a locking member for locking the plunger 93 at the bottom dead position Q2 when the plunger 93 reaches the bottom dead position Q2. The locking member may include the first hook 911 and the second hook 931. The first hook 911 and the second hook 931 may have complementary shapes so that the plunger 93 is not moved in a direction reverse to the longitudinal direction A when the first hook 911 and the second hook 931 are coupled to each other. The first hook 911 and the second hook 931 may function as a reverse movement preventing member for preventing the plunger 93 from being moved in the reverse direction after the plunger 93 reaches the bottom dead position Q2.

When the user moves the plunger 93 toward the top dead position Q1 after injection of toner is completed, toner attached to the plunger 93 may be exposed to the outside of the body 91. The leaked toner may contaminate the interior of the main body 1 of the printer, and may contaminate the user's hand when the user handles the toner cartridge 9. In the example, since the plunger 93 is locked at the bottom dead position Q2 by the locking member, toner leakage of the plunger 93 may be avoided, and the toner cartridge 9 may be easily handled after toner is injected, thereby improving user convenience.

Figure 6:
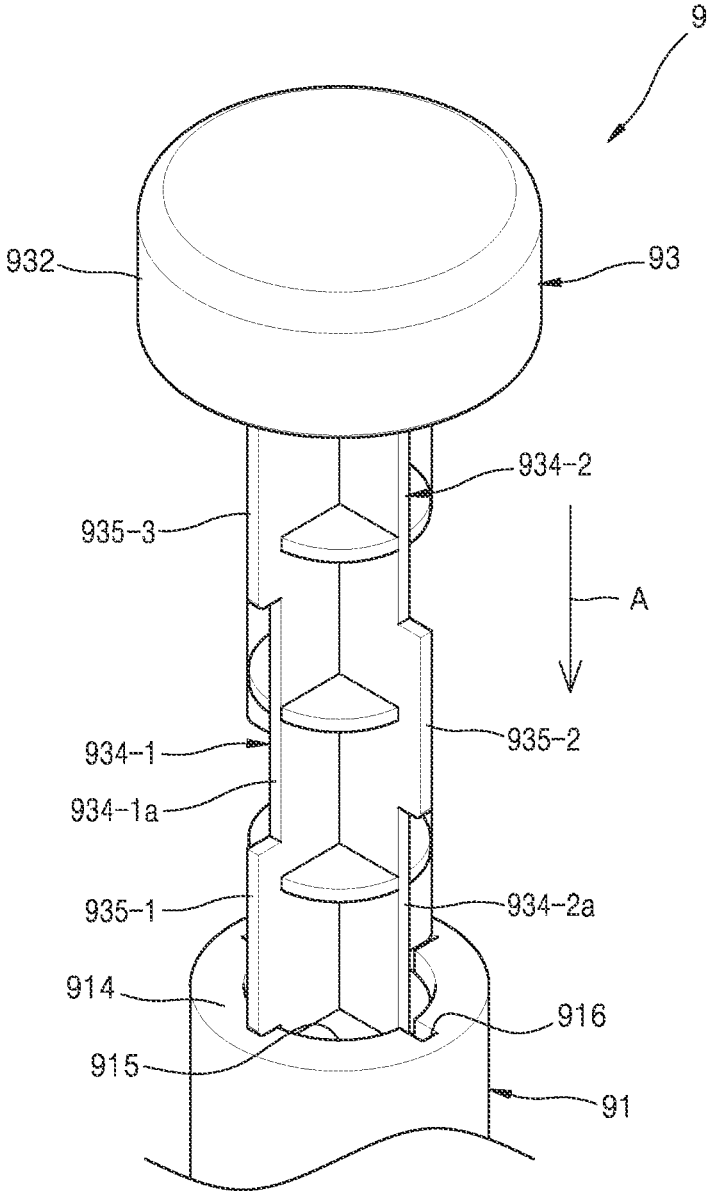
FIG. 6 is a partial perspective view of the toner cartridge according to an example.
Figure 7:
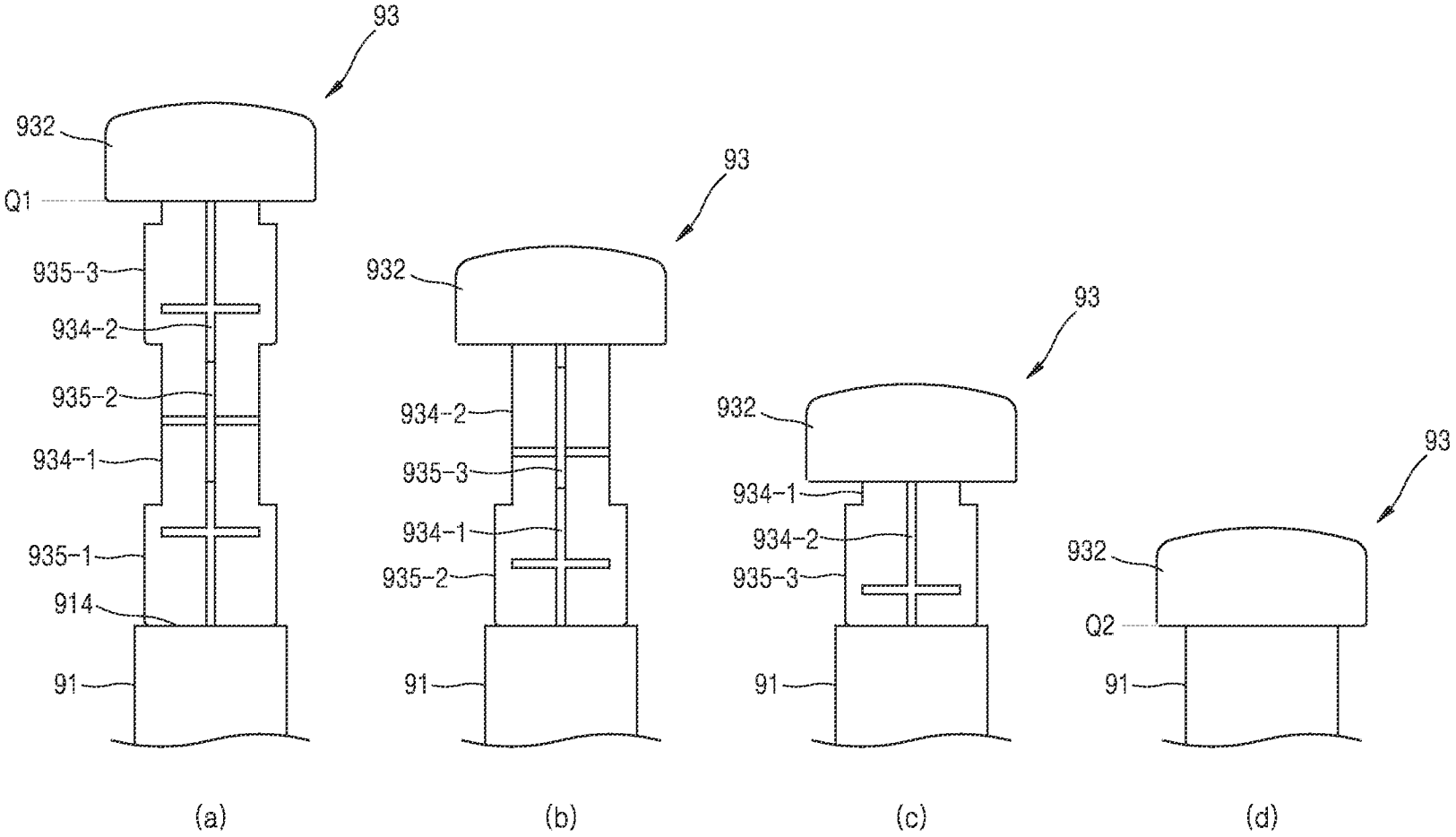
FIG. 7 illustrates a process by which the plunger is moved from a top dead position to a bottom dead position.

FIG. 6 is a partial perspective view of the toner cartridge 9 according to an example. FIG. 7 illustrates a process by which the plunger 93 is moved from the top dead position Q1 to the bottom dead position Q2. In FIGS. 6 and 7, the first hook 911 and the second hook 931 are not shown. Referring to FIGS. 6 and 7, a plurality of stoppers (e.g., first through third stoppers 935-1, 935-2, and 935-3) spaced apart from one another in the longitudinal direction A are provided on an outer circumferential surface of the plunger 93. The first through third stoppers 935-1, 935-2, and 935-3 protrude from the outer circumferential surface of the plunger 93. A projection 914 for catching the first through third stoppers 935-1, 935-2, and 935-3 is provided on a portion of the body 91 opposite to the toner discharge portion 94 so that the plunger 93 is not moved in the longitudinal direction A. A slot 916 is recessed in the projection 914 in a radial direction so that the first through third stoppers 935-1, 935-2, and 935-3 pass through the slot 916 according to a rotational position of the plunger 93. Stoppers that are adjacent to each other in the longitudinal direction A from among the first through third stoppers 935-1, 935-2, and 935-3 have different rotational phases, that is, positions in a rotational direction of the plunger 93. For example, rotational phases of the first stopper 935-1 and the second stopper 935-2 are different from each other, and rotational phases of the second stopper 935-2 and the third stopper 935-3 are different from each other. The number of stoppers depends on the number of movement steps of the plunger 93 in the longitudinal direction A. For example, if the plunger 93 is to be moved in two steps in the longitudinal direction A, two stoppers are used, and if the plunger 93 is to be moved in three steps, three stoppers are used.

In an example, the insertion rod 934 may include a first rib 934-1 and a second rib 934-2 intersecting each other at 90° and extending in the longitudinal direction A. Outer circumferential surfaces 934-1*a* and 934-2*a* of the first rib 934-1 and the second rib 934-2 constitute the outer circumferential surface of the plunger 93. The first through third stoppers 935-1, 935-2, and 935-3 protrude from the outer circumferential surfaces 934-1*a* and 934-2*a* of the first rib 934-1 and the second rib 934-2. For example, the first stopper 935-1 and the third stopper 935-3 may be formed on the first rib 934-1, and the second stopper 935-2 may be formed on the second rib 934-2. Accordingly, the first stopper 935-1 and the second stopper 935-2 that are adjacent to each other in the longitudinal direction A are spaced apart from each other by 90°, and the second stopper 935-2 and the third stopper 935-3 that are adjacent to each other in the longitudinal direction A are spaced apart from each other by 90°.

The projection 914 has a hole 915 through which the outer circumferential surfaces 934-1*a* and 934-2*a* of the first rib 934-1 and the second rib 934-2 pass. The first stopper 935-1, the second stopper 935-2, and the third stopper 935-3 may be caught by the projection 914, and the plunger 93 may not be moved in the longitudinal direction A. The slot 916 is recessed in the projection 914. The slot 916 outwardly extends from an edge of the hole 915. The slot 916 has a shape through which the first stopper 935-1, the second stopper 935-2, and the third stopper 935-3 may pass.

Before the toner cartridge 9 that is new is used, the plunger 93 is located at the top dead position Q1. Before the toner cartridge 9 is mounted on the toner refilling portion 240 or before the toner discharge portion 94 is opened by the discharge shutter 95, when the plunger 93 is pressed toward the bottom dead position Q2, pressure applied to toner in the inner space 92 may be increased. In the example, as shown in FIGS. 6 and 7(*a*), since the first stopper 935-1 is caught by the projection 914 when the plunger 93 is located at the top dead position Q1, the plunger 93 may not be moved in the longitudinal direction A. Accordingly, the plunger 93 may be maintained at the top dead position Q1.

After the toner cartridge 9 is mounted on the toner refilling portion 240, the plunger 93 is located at a release position at which the first stopper 935-1 is aligned with the slot 916 by rotating the plunger 93 by, for example, 90°. Next, the plunger 93 may be moved in the longitudinal direction A by being pressed. As such, the first stopper 935-1, the projection 914, and the slot 916 may function as a movement preventing portion for selectively allowing the plunger 93 to be moved to the bottom dead position Q2 according to a rotational position of the plunger 93 when the plunger 93 is located at the top dead position Q1.

Since the first stopper 935-1 may pass through the slot 916 when the plunger 93 is located at the release position, the plunger 93 may be moved in the longitudinal direction A. The plunger 93 may be moved in the longitudinal direction A until the second stopper 935-2 is caught by the projection 914 as shown in FIG. 7(*b*) by pressing the plunger 93. The second stopper 935-2 may be aligned with the slot 916 by rotating the plunger 93 again by 90°, and the plunger 93 may be moved in the longitudinal direction A until the third stopper 935-3 is caught by the projection 914 as shown in FIG. 7(*c*) by pressing the plunger 93. Next, the third stopper 935-3 may be aligned with the slot 916 by rotating the plunger 93 by 90°, and the plunger 93 may be moved to the bottom dead position Q2 by pressing the plunger 93 as shown in FIG. 7(*d*).

The first hook 911 and the second hook 931 are respectively located on the body 91 and the plunger 93 so that the first hook 911 and the second hook 931 are coupled to each other when the plunger 93 reaches the bottom dead position Q2 in consideration of rotation of the plunger 93. When the plunger 93 reaches the bottom dead position Q2, the first hook 911 and the second hook 931 may be elastically coupled to each other and a user may recognize that injection of toner is completed, thereby making it possible for the plunger 93 to be locked at the bottom dead position Q2.

When the plunger 93 is quickly moved from the top dead position Q1 to the bottom dead position Q2 at one time, toner and air in the toner cartridge 9 may be quickly injected into the development cartridge 2 and internal pressure of the development cartridge 2 may be suddenly increased. In this case, toner may leak through a joint or a portion where sealing of the development cartridge 2 is weak. Also, the sudden increase in the internal pressure of the development cartridge 2 may act as resistance to the movement of the plunger 93 and may obstruct the smooth movement of the plunger 93 in the longitudinal direction A. In the example, since the plunger 93 is moved stepwise from the top dead position Q1 to the bottom dead position Q2, the sudden increase in the internal pressure of the development cartridge 2 and difficulties thereof may be solved.

Figure 8:
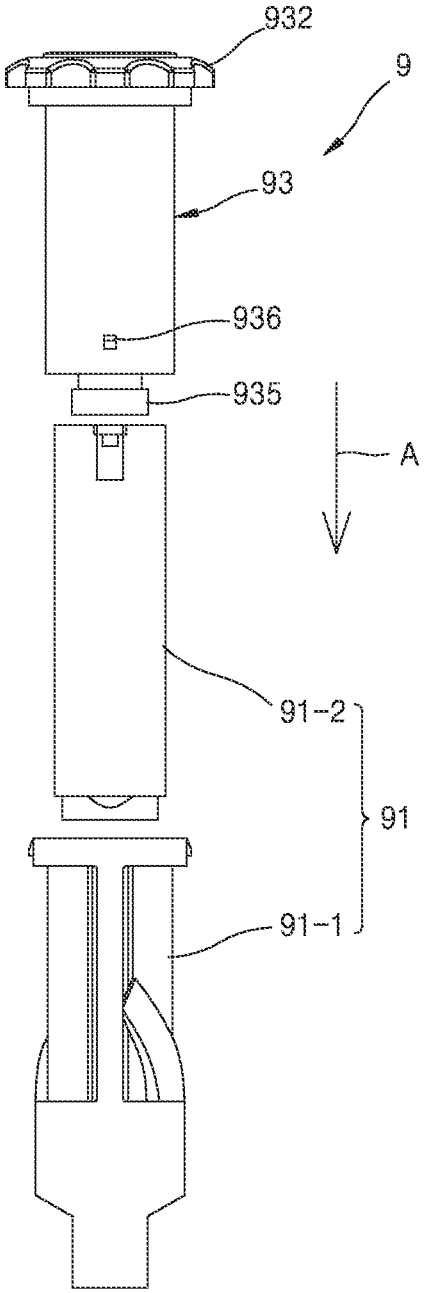
FIG. 8 is an exploded view of the toner cartridge according to an example.
Figure 9:
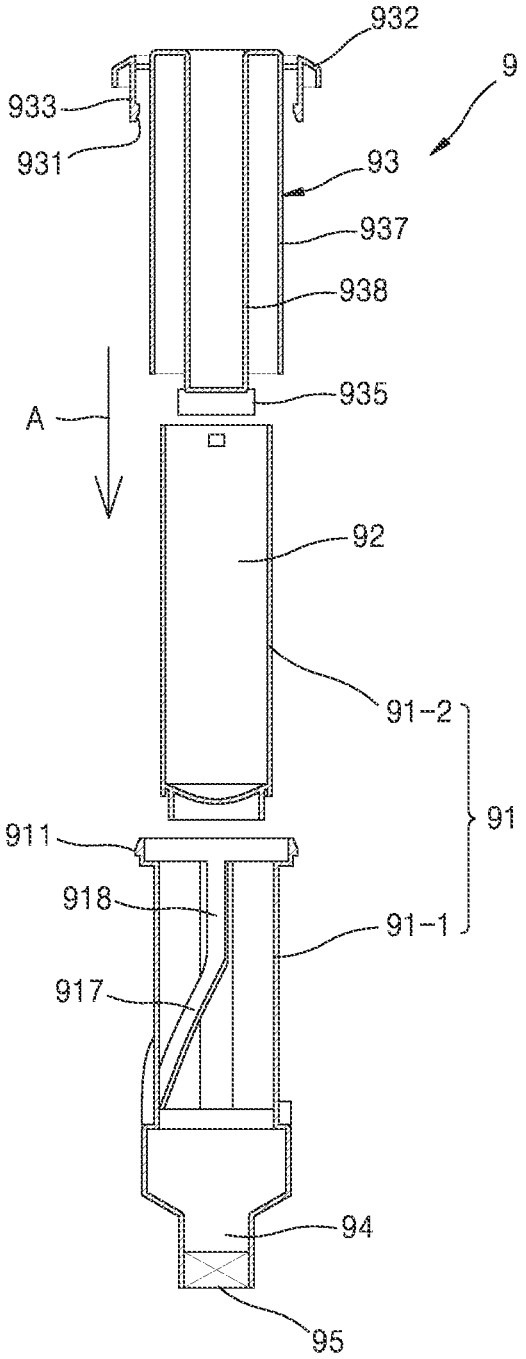
FIG. 9 is an exploded cross-sectional view of the toner cartridge of FIG. 8, according to an example.

FIG. 8 is an exploded view of the toner cartridge 9 according to an example. FIG. 9 is an exploded cross-sectional view of the toner cartridge 9 of FIG. 8, according to an example. Referring to FIGS. 8 and 9, a spiral groove 917 may be formed in the body 91, and a guide protrusion 936 guided by the spiral groove 917 may be provided on the plunger 93. The spiral groove 917 rotates about the longitudinal direction A and extends in the longitudinal direction A.

For example, the body 91 may include an outer body 91-1 in which the spiral groove 917 is formed and an inner body 91-2 received in the outer body 91-1 and having the inner space 92 therein. The plunger 93 may include a guide body 937 inserted between the outer body 91-1 and the inner body 91-2 and including the guide protrusion 936 provided thereon, and a plunger portion 938 inserted into the inner body 91-2. The guide body 937 and the plunger portion 938 may extend from the pressing portion 932 in the longitudinal direction A. The first hook 911 may be provided on the outer body 91-1. The second hook 931 may be provided on the pressing portion 932. The first hook 911 and the second hook 931 may be the same as, for example, the first hook 911 and the second hook 931 of FIG. 5.

In this configuration, when the plunger 93 is moved in the longitudinal direction A, the plunger 93 is guided by the spiral groove 917 and rotates about the longitudinal direction A. A user has to press the plunger 93 and rotate the plunger 93 at the same time. Accordingly, since a movement speed of the plunger 93 is reduced, sudden injection of toner into the development cartridge 2 and thus a sudden increase in an internal pressure of the development cartridge 2 may be prevented.

FIGS. 8 and 9 illustrate an insertion groove 918 allowing the guide protrusion 936 to be inserted thereinto when the plunger 93 is located at the top dead position Q1, formed in the body 91, for example, the outer body 91-1, to linearly extend in the longitudinal direction A, and connected to the spiral groove 917. In this configuration, at an initial time when the plunger 93 is moved in the longitudinal direction A from the top dead position Q1, resistance to the movement of the plunger 93 may be reduced. Accordingly, the user may easily move the plunger 93 in the longitudinal direction A at an initial time of toner injection. As the guide protrusion 936 escapes from the insertion groove 918 and starts to be guided by the spiral groove 917, the plunger 93 starts to be moved in the longitudinal direction A and rotate about the longitudinal direction A at the same time. Accordingly, the plunger 93 may be prevented from being quickly moved.

The first hook 911 and the second hook 931 are respectively located on the body 91 and the plunger 93 so that the first hook 911 and the second hook 931 are coupled to each other when the plunger 93 reaches the bottom dead position Q2 in consideration of rotation of the plunger 93. When the plunger 93 reaches the bottom dead position Q2, the first hook 911 and the second hook 931 may be elastically coupled to each other and the user may recognize that injection of toner is completed, thereby making it possible for the plunger 93 to be locked at the bottom dead position Q2.

Although an electrophotographic printer to which the toner cartridge 9 is applied has been described with reference to FIGS. 1 through 3, a structure of a printer is not limited to that of FIGS. 1 through 3. Although not shown, a toner container (not shown) having the toner refilling portion 240 and connected to the development cartridge 2 may be provided on the main body 1, and the toner cartridge 9 may refill toner in the toner container. Also, the toner cartridge 9 may be coupled to the toner refilling portion 240 even when the development cartridge 2 is removed from the body 1 and the development cartridge 2 may be refilled with toner. The toner cartridge 9 may be connected to the toner refilling portion 240 of the toner container even when the toner container is removed from the main body 1 and the toner container may be refilled with toner.

While the disclosure has been shown and described with reference to examples thereof, they are provided for illustration and it will be understood that various modifications and equivalent other examples may be made from the disclosure. Accordingly, the technical scope of the disclosure is defined by the technical spirit of the appended claims.

What is claimed is:

1. A toner cartridge, comprising:

a hollow body including an inner space in which toner is received and a toner discharge portion through which the toner is discharged;

a plunger, accommodated in the inner space, movable from a first position to a second position along the inner space to push the toner through the toner discharge portion;

a first hook provided on the body; and a second hook, provided on the plunger and having a shape complementary to a shape of the first hook, to be elastically coupled to the first hook when the plunger is at the second position.

2. The toner cartridge of claim 1, further comprising an elastic arm to support at least one of the first hook or the second hook.

3. The toner cartridge of claim 1, further comprising a movement preventing portion to selectively allow the plunger to be moved to the second position according to a rotational position of the plunger when the plunger is located at the first position.

4. The toner cartridge of claim 3, wherein the movement preventing portion includes:

a stopper provided on the plunger, a projection, provided on a portion of the body opposite to another portion of the body at which the toner discharge portion is provided, to catch the stopper, and a slot formed in the projection so that the stopper passes through the slot when the plunger rotates to a release position at which the stopper is aligned with the slot in a longitudinal direction of the plunger.

5. The toner cartridge of claim 1, comprising:

a plurality of stoppers provided on an outer circumferential surface of the plunger and spaced apart from one another in a longitudinal direction of the plunger, at least two of the stoppers among the plurality of stoppers being adjacent to each other in the longitudinal direction and being spaced apart from one another in a rotational direction of the plunger;

a projection, provided on a portion of the body opposite to another portion of the body at which the toner discharge portion is provided, to catch the plurality of stoppers to prevent movement of the plunger in the longitudinal direction; and a slot recessed in the projection in a radial direction of the body so that each of the plurality of stoppers respectively pass through the slot according to a rotational position of the plunger.

6. The toner cartridge of claim 5, wherein the plurality of stoppers include a first stopper caught by the projection at the first position.

7. The toner cartridge of claim 1, comprising:

a spiral groove formed in the body; and a guide protrusion provided on the plunger to be guided by the spiral groove when the plunger is moved from the first position to the second position.

8. The toner cartridge of claim 7, further comprising an insertion groove to allow the guide protrusion to be inserted into the insertion groove when the plunger is at the first position, the insertion groove being formed in the body to linearly extend in a longitudinal direction of the body, and connected to the spiral groove.

9. The toner cartridge of claim 8, wherein the body includes:

an outer body in which the insertion groove and the spiral groove are formed, and an inner body received in the outer body and including the inner space therein, and the plunger includes:

a guide body inserted between the outer body and the inner body and including the guide protrusion provided thereon, and a plunger portion inserted into the inner body.

10. The toner cartridge of claim 1, wherein the plunger comprises:

a packing portion at a first end, the packing portion to contact and push the toner through the toner discharge portion; and a pressing portion at a second end that is opposite to the first end.

11. The toner cartridge of claim 10, wherein the pressing portion includes an upper wall and a side wall extending from the upper wall, and wherein the second hook is provided on an end portion of an elastic arm extending from the upper wall.

12. The toner cartridge of claim 11, wherein the body includes a sunken portion at an end of the body that is opposite the toner discharge portion, and wherein the first hook is provided on the sunken portion.

13. The toner cartridge of claim 12, wherein the side wall is to surround the sunken portion when the plunger is located at the second position.

14. The toner cartridge of claim 10, wherein the elastic coupling of the second hook to the first hook when the plunger is at the second position is to provide a haptic feedback to the pressing portion.

15. A toner cartridge, comprising:

a hollow body including an inner space in which toner is received and a toner discharge portion through which the toner is discharged;

a plunger, accommodated in the inner space, movable from a first position to a second position along the inner space to push the toner through the toner discharge portion; and a locking member to lock the plunger at the second position when the plunger is at the second position.

16. The toner cartridge of claim 15, wherein the locking member includes:

a first hook provided on the body, and a second hook, provided on the plunger and having a shape complementary to a shape of the first hook, to be elastically coupled to the first hook when the plunger is moved from the first position to the second position so as to lock the plunger at the second position.

17. The toner cartridge of claim 15, further comprising:

a plurality of stoppers provided on an outer circumferential surface of the plunger to be spaced apart from one another in a longitudinal direction of the plunger, at least two of the stoppers among the plurality of stoppers being adjacent to each other in the longitudinal direction and being spaced apart from one another in a rotational direction of the plunger;

a projection, provided on a portion of the body opposite to another portion of the body at which the toner discharge portion is provided, to catch the plurality of stoppers to prevent movement of the plunger in the longitudinal direction; and a slot recessed in the projection in a radial direction of the body so that each of the plurality of stoppers respectively pass through the slot according to a rotational position of the plunger.

18. The toner cartridge of claim 17, wherein the plurality of stoppers include a first stopper caught by the projection at the first position.

19. The toner cartridge of claim 15, further comprising:

a spiral groove formed in the body; and a guide protrusion provided on the plunger to be guided by the spiral groove when the plunger is moved from the first position to the second position.

20. The toner cartridge of claim 19, further comprising an insertion groove to allow the guide protrusion to be inserted into the insertion groove when the plunger is at the first position, the insertion groove being formed in the body to linearly extend in a longitudinal direction of the body, and connected to the spiral groove.

* * * * *